United States Patent [19]

Wyden

[11] 4,214,455

[45] Jul. 29, 1980

[54] HOOD WITH A COOLING DEVICE AND A PRECIPITATOR

[76] Inventor: Stephen Wyden, 16 Court St., Brooklyn, N.Y. 11241

[21] Appl. No.: 904,039

[22] Filed: May 8, 1978

[51] Int. Cl.[2] ..... F25B 33/00

[52] U.S. Cl. ..... 62/467 R; 98/115 R

[58] Field of Search ..... 62/305, 467 R; 165/16; 126/299 D; 98/115 R

[56] References Cited

U.S. PATENT DOCUMENTS

| | | | |
|---|---|---|---|
| 3,186,183 | 6/1965 | Murdoch | 62/305 |
| 3,618,659 | 11/1971 | Rawal | 165/16 |
| 3,886,760 | 6/1975 | Wyden | 62/114 |
| 4,057,978 | 11/1977 | Sato et al. | 98/115 R |

*Primary Examiner*—Ronald C. Capossela

[57] ABSTRACT

A hood is disclosed which can be mounted over a work area or in a cooling tower. The hood can contain a cooling device and an electrostatic precipitator can be attached to the cooling device. A compressor and expansion chamber can be attached to the cooling device.

5 Claims, 3 Drawing Figures

HOOD WITH A COOLING DEVICE AND A PRECIPITATOR

BACKGROUND OF THE INVENTION

This invention is a modification and adaptation of U.S. Pat. No. 3,886,760.

Many processes are known that produce as a bi-product or waste an aerosol material. Disposal of such materials may be a problem and may represent a waste of a resource such as heat. Waste steam, such as emitted by a power plant, can produce an aerosol material if cooled. These aerosol materials may be recovered for reuse or proper disposal in accordance with this disclosure.

BRIEF DESCRIPTION OF THE INVENTION

A modified hood is described for use with an aerosol which may consist of a lubricant dispersed in a fluid medium. An aerosol derived from cooling steam may also be treated by an embodiment of this device.

A hood may be mounted over the work area and the work area and hood may be electrostatically charged. A cooling device incorporating and electrostatically charged precipitator may be incorporated in the cooling device. Precipitation of the aerosol material may effectively recapture the heat carried by the aerosol droplets. In a cooling tower, the cooling device and precipitator may be mounted in the tower to cool and precipitate with minimal interference with air flow and permitting reduced size for the tower or increased efficiency. The cooling precipitator may be connected to a compressor and expansion chamber for further resource recovery. The cooling precipitating element may be removable for cleaning and replacement purposes.

BRIEF DESCRIPTION OF THE FIGURES

My invention can be understood in view of the accompanying figures.

DETAILED DESCRIPTION OF THE PREFERRED EMBODIMENTS

Figure 1:
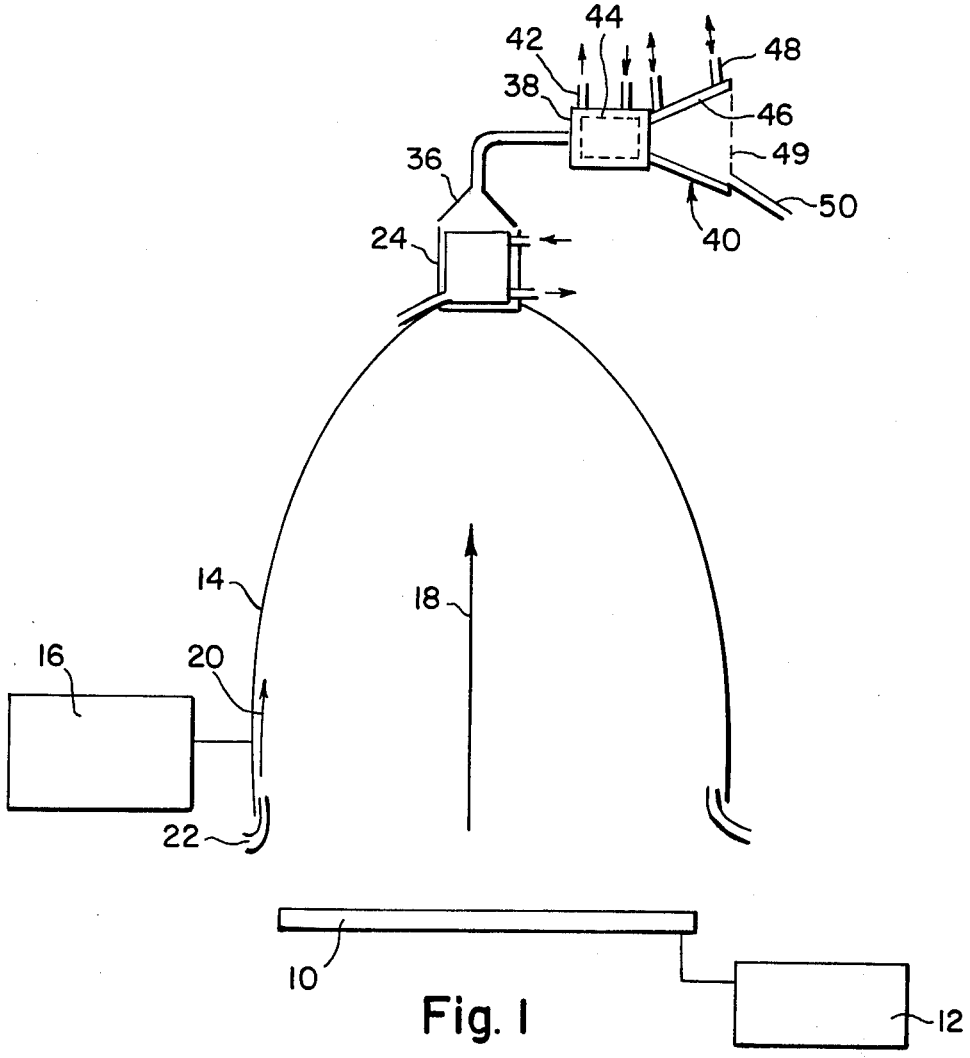
FIG. 1 is a cross-sectional schematic plan view of an electrostatic hood mounted over a work area.
Figure 2:
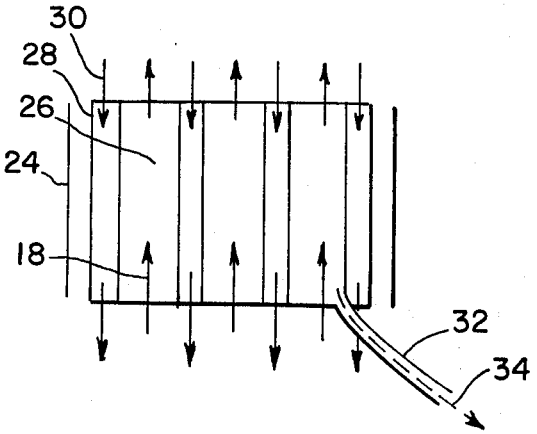
FIG. 2 is a close-up cross-section of a portion of the cooling precipitator.

With regard to FIGS. 1 and 2, a work area 10 can be connected to an electrostatic charging device 12. A hood 14 positioned over the work area can be connected to another electrostatic charging device 16 to guide the aerosol stream 18. Air streams 20 may be introduced along the walls of the hood 14 to guide the stream 18 and to provide a laminar barrier to prevent precipitation of the aerosol on the hood walls. Air jets 22 attached to the lower end of the hood 14 can focus the stream 20 as desired. The cooling precipitator 24 at the top of the hood 14 can cool the stream 18 and precipitate aerosol materials from the aerosol stream 18. The aerosol passages 26 in the precipitator 24 are lined and alternate with coolant passages 28 in the precipitator 24 through which a chosen coolant 30 may flow. In as much as the walls of the coolant passages 28 also serve to collect aerosol material, tubes 32 connected to a lower edge of the aerosol passages 26 may conduct the precipitated aerosol material 34 away through the side of the precipitator 24. An inverted connector funnel 36 above the precipitator 24 leads to a compressor 38 which is connected to an expansion chamber 40. Thermal exchange passages 42 connected through the surface of the compressor 38 may be used to cool the compressor jacket 44 and thereby the compressor 38. A thermal exchange jacket 46 around the expansion chamber 40 can be connected by passages 48 to an outside source to exchange heat with the expansion chamber 40 as desired. An entrained material filter 49 and collection tube 50 at the large discharge end of the expansion chamber 40 can be used to collect or dispose of material removed by the expansion chamber.

Figure 3:
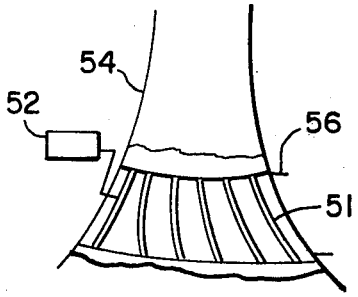
FIG. 3 is a side view in partial section of a cooling tower with a cooling precipitator mounted therein.

With regard to FIG. 3, a cooling precipitator 51 can be connected to an electrostatic charging device 52. The precipitator 51 is seen mounted in the lower interior end of a cooling tower and is connected to an external device by tubes 56 to reuse heat recovered in the precipitator 51. Water could be recovered at the bottom of the tower 54.

It may thus be seen that the objects set forth above may be attained from the preceeding description but since certain changes may be made in the above embodiment without departing from the spirit or scope of the invention, it is intended that all matter contained in the above description and shown in the accompanying drawings shall be interpreted as illustrative and not in a limiting sense.

It is also to be understood that the following claims are intended to cover all the generic and specific features of the invention as berein described as well as any statements of the scope of the invention which may fall there-between.

What I claim as new and desire to secure by Letters Patent is:

1. A hood, comprising:
   a hood,
   a cooling device attached to a first end of the hood,
   an electrostatic precipitator connected to an interior aerosol stream contacting surface in the cooling device,
   an air jet interiorly attached to the hood to direct an air jet driven laminar flow along a wall of the hood,
   whereby the aerosol stream may be driven into contact with the electrostatic precipitator surface with minimal hood contamination.

2. The hood of claim 1, further comprising:
   the hood mounted over a work area,
   the work area having a means for forming the aerosol stream,
   means of electrostatically charging the work area,
   means of electrostatically charging the hood, and
   the charge of the work area and the charge of the hood of a charge opposite to the charge of the precipitator.

3. The hood of claim 1, wherein the hood is a cooling tower, and
   the cooling device is mounted in an interior of the cooling tower.

4. The hood of claim 2, wherein the aerosol material passes
   from the cooling device to a compressor,
   an expansion chamber is connected to the compressor, and
   a filter is attached to the expansion chamber.

5. The hood of claim 4, wherein a means of thermal exchange is
   attached to the compressor, and
   another means of thermal exchange is attached to the expansion chamber.

* * * * *